US009108824B2

(12) United States Patent
Hughes et al.

(10) Patent No.: US 9,108,824 B2
(45) Date of Patent: Aug. 18, 2015

(54) REMOTE ACCESS OF AN ELEVATOR CONTROL SYSTEM WITH MULTIPLE SUBSYSTEMS

(75) Inventors: David M. Hughes, East Hartford, CT (US); Sally Day Mahoney, New Hartford, CT (US); Donald M. Sakonchick, Avon, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 777 days.

(21) Appl. No.: 13/395,780

(22) PCT Filed: Sep. 16, 2009

(86) PCT No.: PCT/US2009/057120

§ 371 (c)(1),
(2), (4) Date: Mar. 13, 2012

(87) PCT Pub. No.: WO2011/034527

PCT Pub. Date: Mar. 24, 2011

(65) Prior Publication Data

US 2012/0175196 A1 Jul. 12, 2012

(51) Int. Cl.
*B66B 1/28* (2006.01)
*B66B 1/34* (2006.01)

(52) U.S. Cl.
CPC ..... *B66B 1/34* (2013.01); *B66B 1/3415* (2013.01); *B66B 1/3438* (2013.01); *B66B 1/3461* (2013.01)

(58) Field of Classification Search
CPC ..... B66B 5/02; B66B 1/34; B66B 1/3446; B66B 1/3461; B66B 5/0018; B66B 5/0025; B66B 1/3415; B66B 1/3438
USPC ..... 187/247, 391, 393
See application file for complete search history.

(56) References Cited

U.S. PATENT DOCUMENTS 3,973,648 A * 8/1976 Hummert et al. ..... 187/393
4,568,909 A 2/1986 Whynacht (Continued)

FOREIGN PATENT DOCUMENTS

EP 0586190 A1 3/1994
EP 0731050 A2 9/1996

(Continued)

OTHER PUBLICATIONS

PCT International Search Report and Written Opinion of the International Searching Authority for International Application No. PCT/US2009/057120, Jun. 16, 2010, 11 pages.

(Continued)

*Primary Examiner* — Anthony Salata
(74) *Attorney, Agent, or Firm* — Cantor Colburn LLP

(57) ABSTRACT

A method and system for remote access to multiple subsystems (102) of an elevator control system (104) are provided. The method includes receiving a request to establish a remote connection at an elevator control subsystem (112) from a remote user system (110). The method also includes determining whether a local connection is established between the elevator control subsystem (112) and service equipment (120). The method further includes establishing the remote connection in response to determining that the local connection is not established between the elevator control subsystem (112) and the service equipment (120). The method additionally includes sending a time since the service equipment (120) was last active and providing an option to complete the remote connection in response to determining that the local connection is established, the elevator control subsystem (112) is operating in a first mode of operation, and a configurable local activity timeout period has not expired.

18 Claims, 4 Drawing Sheets

(56) References Cited

U.S. PATENT DOCUMENTS

| | | | | | |
|---|---|---|---|---|---|
| 4,703,325 | A | | 10/1987 | Chamberlin et al. | |
| 4,762,204 | A | * | 8/1988 | Blain et al. | 187/247 |
| 4,823,914 | A | | 4/1989 | McKinney et al. | |
| 4,930,604 | A | * | 6/1990 | Schienda et al. | 187/393 |
| 4,958,707 | A | | 9/1990 | Yoneda et al. | |
| 5,007,506 | A | | 4/1991 | Suzuki et al. | |
| 5,084,863 | A | * | 1/1992 | Guezou et al. | 370/223 |
| 5,202,540 | A | * | 4/1993 | Auer et al. | 187/247 |
| 5,254,813 | A | | 10/1993 | Hirashiki | |
| 5,398,782 | A | | 3/1995 | Talbot et al. | |
| 5,445,245 | A | | 8/1995 | Ketoviita | |
| 5,551,532 | A | * | 9/1996 | Kupersmith | 187/391 |
| 5,832,363 | A | * | 11/1998 | Moriya et al. | 455/11.1 |
| 6,986,408 | B2 | * | 1/2006 | Takeuchi | 187/380 |
| 7,002,462 | B2 | | 2/2006 | Welch | |
| 7,398,860 | B2 | | 7/2008 | Amano | |
| 7,419,032 | B2 | * | 9/2008 | Yamakawa | 187/247 |
| 7,857,105 | B2 | * | 12/2010 | Roydhouse | 187/391 |
| 8,065,156 | B2 | * | 11/2011 | Gazdzinski | 704/275 |
| 8,069,958 | B2 | * | 12/2011 | Lence-Barreiro | 187/393 |
| 2002/0059412 | A1 | | 5/2002 | Azpitarte | |
| 2014/0069745 | A1 | * | 3/2014 | Dellarippa et al. | 187/381 |

FOREIGN PATENT DOCUMENTS

| | | | |
|---|---|---|---|
| JP | 2005346424 | A | 12/2005 |
| JP | 2006067507 | A | 3/2006 |
| JP | 2006199411 | A | 8/2006 |

OTHER PUBLICATIONS

Qameleon Technology—QarVision Elevator Performance Analyzer Specifications, [online]; [retrieved on Aug. 12, 2009]; retrieved from the Internet http://www.qameleon.com/protected/home/htm, 5 pages.

R. Madarasz et al., Continuous Performance Monitoring of Elevators, Elevator Word, Aug. 2008—vol. LVI, No. 8, 3 pages.

Swift Futura—Elevator Control and Management System Specifications, [online], [retrieved on Aug. 12, 2009], retrieved from the Internet http://www.swiftcec.com/support/quotes.html, 31 pages.

Swift Meridia—Elevator Control and Management System Specifications, [online], [retrieved on Aug. 11, 2009]; retrieved on the internet http://www.swiftcec.com/support/quotes.html, 32 pages.

* cited by examiner

REMOTE ACCESS OF AN ELEVATOR CONTROL SYSTEM WITH MULTIPLE SUBSYSTEMS

BACKGROUND OF THE INVENTION

The subject matter disclosed herein relates to elevator control system access. More particularly, the subject matter disclosed herein relates to remote access of an elevator control system with multiple subsystems.

Most elevator control systems include multiple subsystems that perform various functions to control an elevator. Examples of elevator control subsystems include an operational control and dispatching subsystem, a motion control subsystem, a drive control subsystem, and a door control subsystem. In order to maintain and service these types of elevator control systems, an elevator mechanic or technician may directly troubleshoot each subsystem in an elevator control room. Alternatively, a communication unit can be physically attached to a specific subsystem for remote diagnosis of the subsystem using a remote access device. In order to trouble-shoot or maintain multiple subsystems, each subsystem is individually accessed and interrogated by directly connecting service equipment or directly connecting the communication unit to each subsystem. Elevator control systems may also support passing commands from higher-level subsystems down to lower level subsystems in a control system hierarchy.

BRIEF DESCRIPTION OF THE INVENTION

According to one aspect of the invention, is method for providing remote access to multiple subsystems of an elevator control system. The method includes receiving a request to establish a remote connection at an elevator control subsystem from a remote user system via a communication unit connected to the elevator control subsystem of the multiple subsystems. The method also includes determining whether a local connection is established between the elevator control subsystem and service equipment. The method further includes establishing the remote connection in response to determining that the local connection is not established between the elevator control subsystem and the service equipment. The method additionally includes sending a time since the service equipment was last active and providing an option to complete the remote connection in response to determining that the local connection is established, the elevator control subsystem is operating in a first mode of operation, and a configurable local activity timeout period has not expired.

According to another aspect of the invention, a system for remote access to multiple subsystems of an elevator control system is provided. The system includes an elevator control subsystem of the multiple subsystems configurable to communicate with a remote user system via a communication unit. The elevator control subsystem includes a service interface configurable to communicate with service equipment. The elevator control subsystem also includes a communication timer and an external communication interface configurable to communicate with the communication unit. The elevator control subsystem additionally includes a processing circuit to execute remote access logic. The remote access logic receives a request to establish a remote connection at the elevator control subsystem from the remote user system via the external communication interface. The remote access logic determines whether a local connection is established between the elevator control subsystem and service equipment via the service interface. The remote access logic also establishes the remote connection in response to determining that the local connection is not established between the elevator control subsystem and the service equipment. The remote access logic sends a time since the service equipment was last active and provides an option to complete the remote connection in response to determining that the local connection is established, the elevator control subsystem is operating in a first mode of operation, and a configurable local activity timeout period has not expired as monitored using the communication timer.

According to a further aspect of the invention, a computer program product for remote access to multiple subsystems of an elevator control system is provided. The computer program product includes a storage medium readable by a processing circuit and storing instructions for execution by the processing circuit for implementing the previously described method.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Exemplary embodiments provide remote access to multiple subsystems of an elevator control system. Remote access enables qualified elevator personnel to access the elevator control system, including the ability to navigate and interrogate all of the subsystems associated with direct control of an elevator. The qualified elevator personnel can obtain detailed elevator diagnostic information, monitor elevator control, and customize operation of the elevator from any subsystem within the elevator control system. Remote access logic implemented in the elevator control system also manages arbitration and priority of local and remote connections.

Figure 1:
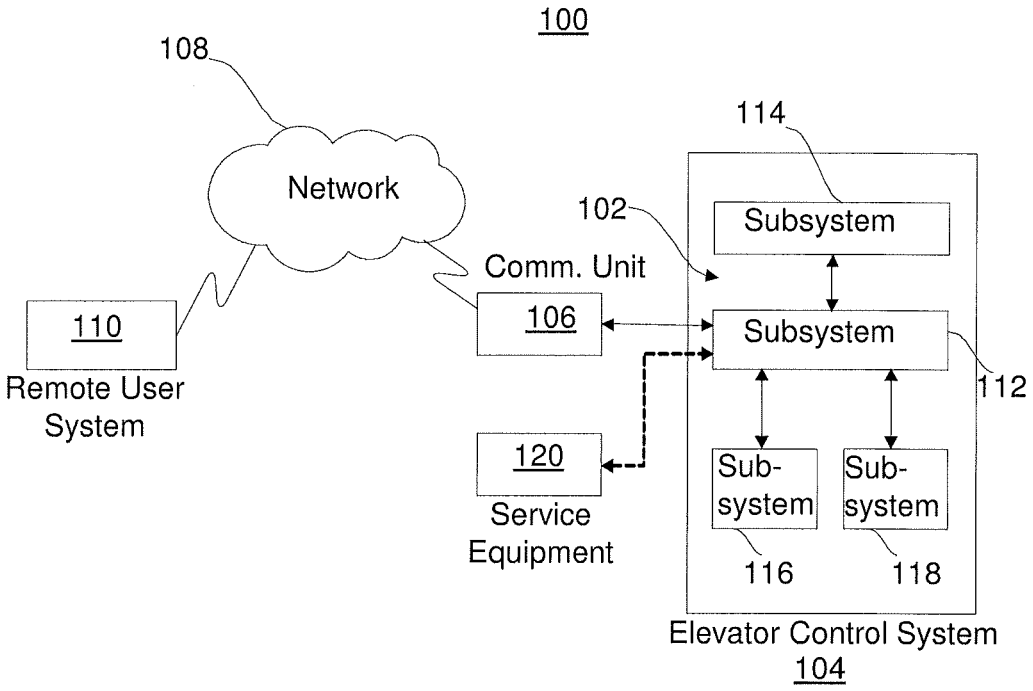
FIG. 1 is an example of a system for remotely accessing multiple subsystems of an elevator control system.

FIG. 1 is an example of a system 100 for remotely accessing multiple subsystems 102 of an elevator control system 104. In order to establish remote access with the elevator control system 104, a communication unit 106 interfaces with the elevator control system 104 and a network 108. A remote user system 110 can also interface to the network 108 at a remote location to establish a bi-directional communication link between the remote user system 110 and the communication unit 106. The remote user system 110 may be a desktop, laptop, general-purpose computer device, and/or other networked device with a processing circuit and I/O interfaces, such as a keyboard and display device, including web-enabled phones and handheld devices. The network 108 may be any type of communications network known in the art. For example, the network 108 can be a plain old telephone service (POTS) network, an intranet, extranet, or an internetwork, such as the Internet, or a combination thereof. The network 108 can include wireless, wired, and/or fiber optic links.

In an exemplary embodiment, the communication unit 106 performs a protocol conversion from a network-compatible format of the network 108 to a control system communication format for interfacing with subsystems 102 of the elevator control system 104. The communication unit 106 can be a remote elevator monitoring (REM®) unit or other communication interface device, such as modem or network interface card. Once communication has been established to the elevator control system 104, the remote user system 110 generates a request to connect directly to an elevator control subsystem that is physically connected to the communication unit 106. In the example of FIG. 1, elevator control subsystem 112 is physically connected to the communication unit 106. After a remote connection has been established, the remote user system 110 can request an internal or pass thru connection to any of the subsystems 102 within the elevator control system 104.

In the example of FIG. 1, the subsystems 102 include elevator control subsystem 112, elevator control subsystem 114, elevator control subsystem 116, and elevator control subsystem 118. The subsystems 102 are connected in a hierarchical structure such that under normal operating conditions, the elevator control subsystem 114 can pass commands and data to elevator control subsystem 112, and elevator control subsystem 112 can distribute commands and data to elevator control subsystems 116 and 118. For example, the elevator control subsystem 114 may be an operational control and dispatching subsystem configured to pass commands and data to a motion control subsystem represented by elevator control subsystem 112. The elevator control subsystem 112 then distributes commands and data to targeted underlying subsystems, which may be a drive control subsystem represented by elevator control subsystem 116, and a door control subsystem represented by elevator control subsystem 118.

In the hierarchical arrangement of the subsystems 102 in FIG. 1, elevator control subsystems depicted above other elevator control subsystems are also referred to parent subsystems, and elevator control subsystems depicted below other elevator control subsystems are also referred to child subsystems. For instance, elevator control subsystem 114 is a parent subsystem of elevator control subsystems 112, 116, and 118, while elevator control subsystem 112 is a parent subsystem of elevator control subsystems 116 and 118 but a child subsystem of elevator control subsystem 114. Since the elevator control subsystem 114 is the parent subsystem for all of the elevator control subsystems 112, 116, and 118, the elevator control subsystem 114 is also referred to as master subsystem 114.

The dynamic communication format in exemplary embodiments enables any of the subsystems 102 to act as a communication pass thru device regardless of relative position within the control hierarchy of the subsystems 102. Thus, even though elevator control subsystem 116 is a child subsystem of elevator control subsystems 112 and 114, elevator control subsystem 116 can route remote access communications to the elevator control subsystems 112 and 114 if the elevator control subsystem 116 is connected to the communication unit 106. Accordingly, as depicted in FIG. 1, elevator control subsystem 112 serves as a communication pass thru device to the master subsystem 114, even though the elevator control subsystem 112 is a child subsystem of the master subsystem 114. In the example of FIG. 1, elevator control subsystems 114, 116, and 118 may be referred to secondary elevator control subsystems for purposes of remote access, as primary communication with the communication unit 106 is handled by the elevator control subsystem 112 and remote access commands are passed through to a secondary level relative to the elevator control subsystem 112.

The elevator control system 104 also supports local communication with service equipment 120. The service equipment 120 can be directly connected to any of the subsystems 102 for servicing the subsystem to which it is connected. In an exemplary embodiment, each of the elevator control subsystems 112-118 has one or more service interfaces that support direct connections to the service equipment 120. Both the service equipment 120 and the remote user system 110 can perform elevator service activities. Since the remote user system 110 can access any of the subsystems 102, remote access logic in the subsystems 102 performs arbitration of communication from both the remote user system 110 and the service equipment 120.

In an exemplary embodiment, the elevator control subsystem 112 receives an initial connection request for a remote connection and determines if a local connection with the service equipment 120 has been established to ensure that a remote user does not interrupt the local connection. The local connection is established when service equipment 120 is physically connected to the elevator control subsystem 112. If service equipment 120 is connected, the elevator control subsystem 112 monitors the time since there was any activity from the service equipment 120. If no activity has been detected from the service equipment 120 within a selectable amount of time, the elevator control subsystem 112 grants the remote connection. The remote connection is also granted if no service equipment 120 is connected to the elevator control subsystem 112.

Once the remote connection is established, it cannot be interrupted by a local connection attempt. If a local connection is attempted after the remote connection is established, a warning message is generated and relayed to the remote user system 110 to notify the remote user of a potential conflict. The remote connection may also have a configurable remote activity timeout period to terminate the remote connection for a lack of activity during the configurable remote activity timeout period.

The remote user system 110 can request access to any of the elevator control subsystems 102. Once the remote connection is established between the remote user system 110 and the elevator control subsystem 112, the remote user system 110 may request pass-thru remote access to the elevator control subsystem 114, 116 or 118 as a secondary elevator control subsystem, in which case the elevator control subsystem 112 acts as a communication pass-thru device. In response to a pass-thru request, a check is performed as to whether the targeted subsystem has a local connection established with the service equipment 120. If there is no active local connection, as determined by an absence of a local connection or expiration of a configurable secondary local activity timeout period, then the elevator control subsystem 112 supports the pass-thru connection to secondary elevator control subsystem 114, 116 or 118.

Once a remote connection has been made, the remote user can monitor subsystem activity, interrogate the subsystem for specific data, customize elevator operation, and download data for analysis. To close a remote connection, a request to close the connection may be transmitted to the elevator control subsystem 112. In addition, the elevator control subsystem 112 monitors for a loss of communications with the communication unit 106 in order to close the communication link with the remote user system 110. Closing the communication link for the remote connection may include changing a state of a variable or flag to indicate that local connections can now be supported. Various default control parameters and data can also be reset upon closing the remote connection to return the elevator control system 104 to a known state.

Figure 2:
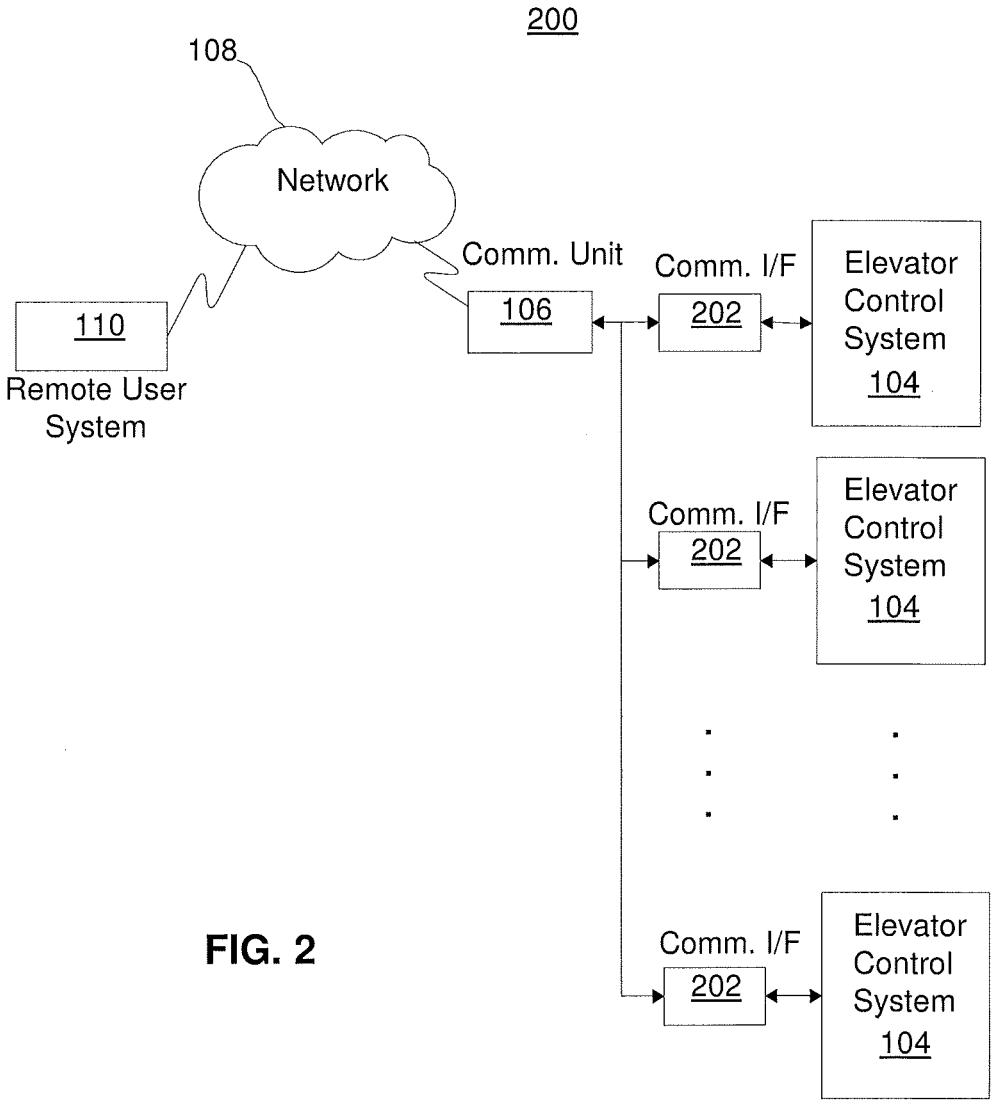
FIG. 2 is an example of a system for remotely accessing multiple subsystems of multiple elevator control systems.

FIG. 2 depicts an example of a system 200 for remotely accessing multiple subsystems of multiple elevator control systems 104. FIG. 2 illustrates an embodiment of multiple elevator control systems 104 connecting to a single communication unit 106. Similar to the system 100 of FIG. 1, a remote user system 110 communicates with communication unit 106 via network 108. However, the system 200 enables multiple elevator control systems 104 to be remotely accessed. Sharing communication unit 106 between multiple elevator control systems 104 may efficiently utilize resources as duplicate communication units 106 can be avoided. In an alternate embodiment, multiple communication units 106 are interfaced to multiple elevator control systems 104. The system 200 may use intermediate communication interfaces 202 to buffer communications and enhance distributed loading, timing, and protocol options between communication unit 106 and multiple elevator control systems 104. The intermediate communication interfaces 202 can support a multi-drop local area network configuration as depicted in FIG. 2. It will be understood that one or more of the intermediate communication interfaces 202 can be integrated into communication unit 106 or elevator control systems 104.

Figure 3:
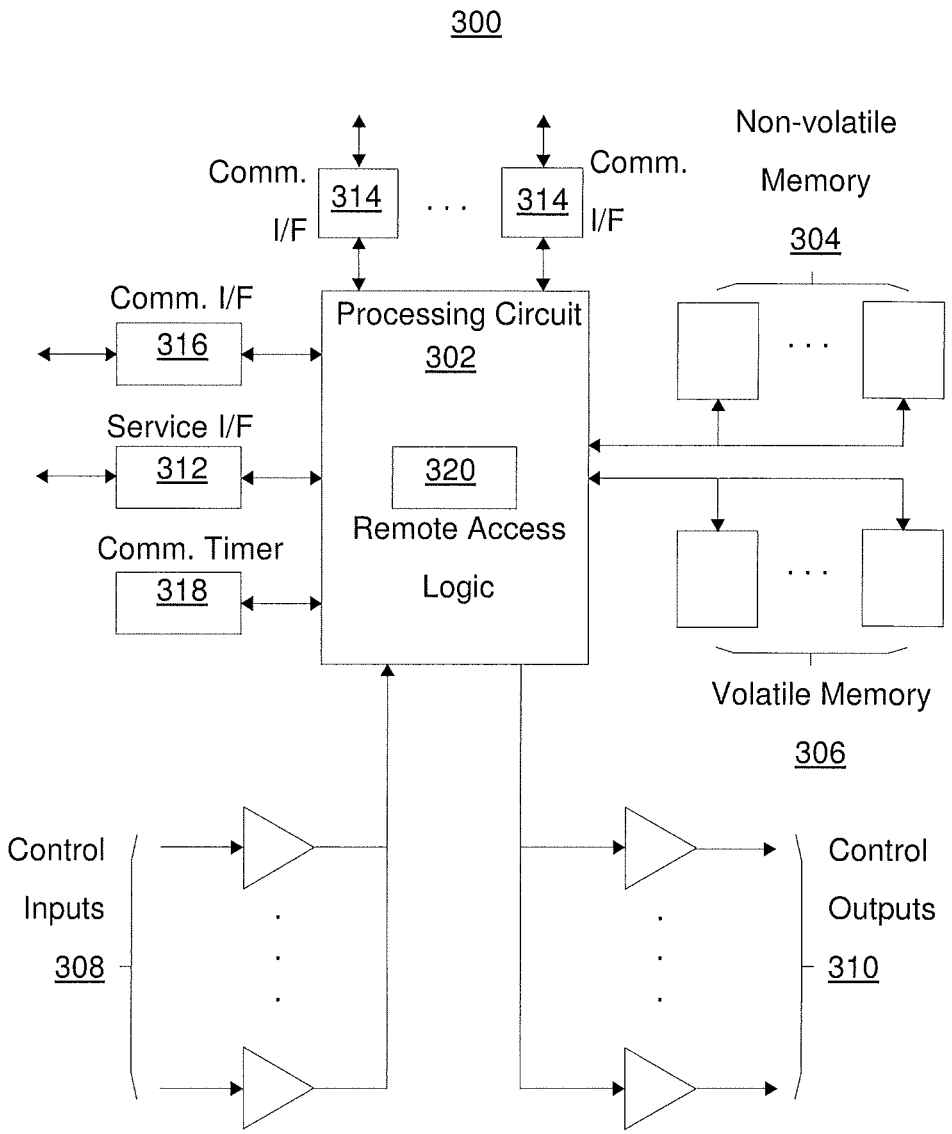
FIG. 3 is a block diagram of an elevator control subsystem in an elevator control system in accordance with exemplary embodiments.

FIG. 3 depicts a block diagram of an elevator control subsystem 300 in accordance with exemplary embodiments. The elevator control subsystem 300 is a hardware architecture that can be used to implement the individual elevator control subsystems 112-118 of FIG. 1. The elevator control subsystem 300 includes a processing circuit 302 that is interfaced to non-volatile memory 304, volatile memory 306, control inputs 308, control outputs 310, service interface 312, subsystem communication interfaces 314, external communication interface 316, and communication timer 318. The processing circuit 302 executes remote access logic 320 that performs the functionality as previous described and further described herein.

The non-volatile memory 304 is a computer-readable storage medium that can include executable programs and data persisting when power is cycled. The volatile memory 306 can hold programs and/or data that do not persist upon power cycling. The control inputs 308 may include signal-conditioning circuitry to acquire analog and/or digital inputs. The control outputs 310 can include signal-conditioning circuitry to drive analog and/or digital outputs. The service interface 312 supports communication with the service equipment 120 of FIG. 1. The subsystem communication interfaces 314 enable inter-subsystem communication, such as between the elevator control subsystem 112 and 114. The subsystem communication interfaces 314 may support a variety of communication formats, such as multi-drop, point-to-point, and multiple unidirectional or bidirectional links. The external communication interface 316 supports communication with the communication unit 106 of FIG. 1. The communication timer 318 can used for establishing timeout periods for communication sessions on the service interface 312, the subsystem communication interfaces 314, and/or the external communication interface 316. The communication timer 318 or other timers (not depicted) may be used to monitor the time since the last activity was detected over various interfaces. Examples of activity monitoring periods that can be tracked using the communication timer 318 include a time since the service equipment 120 was last active, a configurable local activity timeout period, a configurable secondary local activity timeout period, and a configurable remote activity timeout period.

Figure 4:
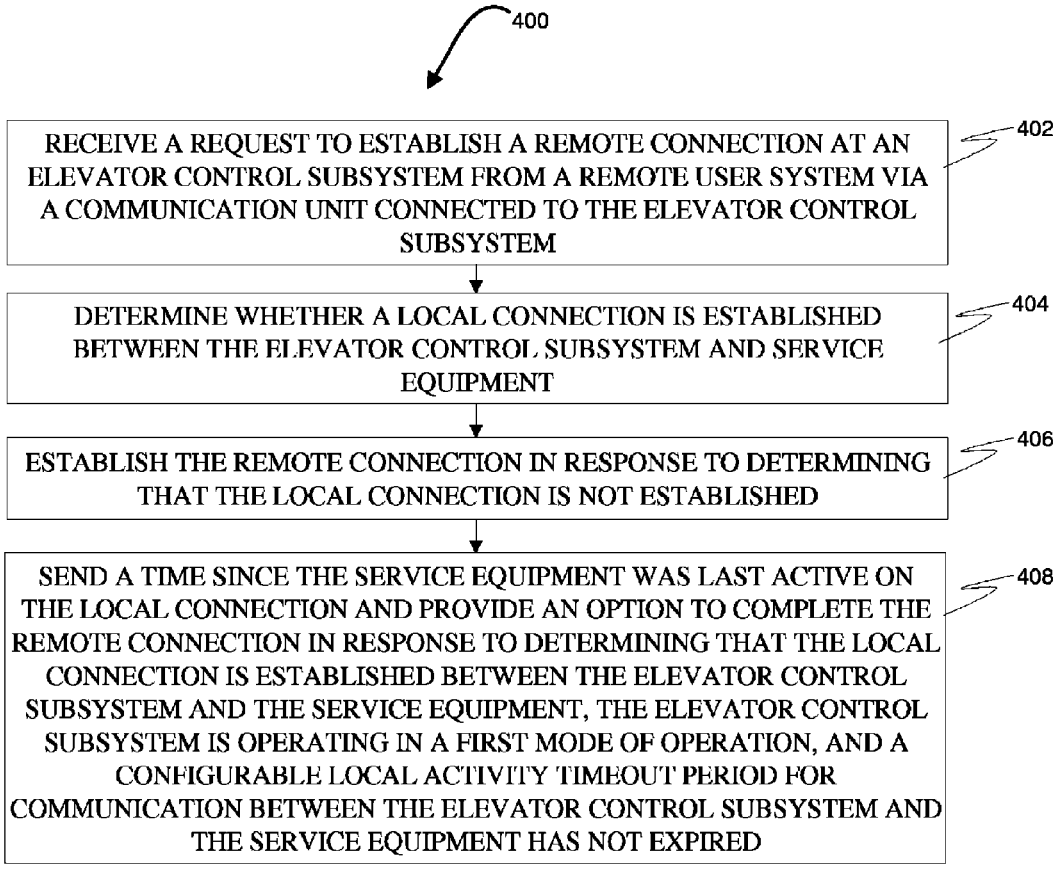
FIG. 4 depicts an exemplary process for providing remote access to multiple subsystems of an elevator control system in accordance with exemplary embodiments.

FIG. 4 depicts an exemplary process 400 for providing remote access to multiple subsystems 102 of an elevator control system 104 in accordance with exemplary embodiments. The process 400 is described in reference to FIGS. 1-3. The process 400 can be implemented in remote access logic 320 of FIG. 3. Although the remote access logic 320 can be installed in any of the multiple subsystems 102 connected to the communication unit 106, for ease of explanation, the process 400 is described in reference to the elevator control subsystem 112 as depicted in FIG. 1.

At block 402, elevator control subsystem 112 receives a request to establish a remote connection from remote user system 110 via communication unit 106 connected to the elevator control subsystem 112. At block 404, the elevator control subsystem 112 determines whether a local connection is established between the elevator control subsystem 112 and service equipment 120. A local connection may be established between the elevator control subsystem 112 and service equipment 120 via service interface 312 if no remote connection is already established.

At block 406, the elevator control subsystem 112 establishes the remote connection in response to determining that the local connection is not established between the elevator control subsystem 112 and the service equipment 120. The remote connection provides the remote user system with remote access functions to monitor activity of the elevator control subsystem 112, interrogate the elevator control subsystem 112 for specific data, customize elevator operation, and download data for analysis in response to establishing the remote connection.

The elevator control subsystem 112 supports multiple modes of operation. In some modes of operation, remote access requests are allowed at the option of a user of the remote user system 110. In other modes of operation, remote access requests are automatically rejected. At block 408, the elevator control subsystem 112 sends a time since the service equipment 120 was last active on the local connection and provides an option to complete the remote connection in response to determining that the local connection is established between the elevator control subsystem 112 and the service equipment 120, the elevator control subsystem 112 is operating in a first mode of operation, and a configurable local activity timeout period for communication between the elevator control subsystem 112 and the service equipment 120 has not expired. The elevator control subsystem 112 may reject the remote connection in response to determining that the local connection is established, and the elevator control subsystem 112 is operating in a second mode of operation.

While the remote connection is established, the elevator control subsystem 112 may receive a request to remotely access a secondary elevator control subsystem, such as elevator control subsystem 114, 116, or 118. The elevator control subsystem 112 determines whether a secondary local connection is established between the secondary elevator control subsystem and the service equipment 120. The elevator control subsystem 112 is configured to act as a communication pass-thru device between the remote user system 110 and the secondary elevator control subsystem in response to determining that the secondary local connection is not established. The elevator control subsystem 112 can send a time since the service equipment 120 was last active on the secondary local connection and provide an option to complete a pass-thru remote connection in response to determining that the secondary local connection is established, the elevator control subsystem 112 is operating in the first mode of operation, and a configurable secondary local activity timeout period for communication between the secondary elevator control subsystem and the service equipment 120 has not expired. The elevator control subsystem 112 may reject the request in response to determining that the secondary local connection is established, and the elevator control subsystem 112 is operating in a second mode of operation. The secondary elevator control subsystem may be a parent subsystem in the control hierarchy of the elevator control system 104, such as elevator control subsystem 114 relative to the elevator control subsystem 112. Thus, the elevator control subsystem 112, as a child subsystem, can serve as a communication pass-thru device to a parent subsystem, even though the parent subsystem may be the master subsystem for control purposes.

The remote user system 110 may be provided with remote access functions via the remote connection and the elevator control subsystem 112 to perform a number of functions on the secondary elevator control subsystem. Examples of remote access functions include monitoring activity of the secondary elevator control subsystem, interrogating the secondary elevator control subsystem for specific data, customizing elevator operation, and downloading data for analysis.

The elevator control subsystem 112 can monitor activity on the remote connection in response to establishing the remote connection, and close the remote connection in response to inactivity on the remote connection for a configurable remote activity timeout period. The elevator control subsystem 112 may also monitor for a local connection attempt in response to establishing the remote connection, and prevent the local connection attempt from establishing the local connection in response to determining that the remote connection is established and a configurable remote activity timeout period has not expired. The elevator control subsystem 112 can also send a local connection attempt warning message to the remote user system 110 in response to detecting the local connection attempt.

Technical effects of exemplary embodiments include providing remote access to multiple subsystems of an elevator control system. Remote access enables rapid diagnose and troubleshooting of elevator malfunctions covering multiple subsystems. Arbitration between local and remote connections provides priority to the remote user and prevents a local connection when a remote connection has been established. The configurability of the remote access communication protocol enables any subsystem connected to a communication unit to act as a communication pass-thru device regardless of relative position in the control hierarchy, thus eliminating the need for a top-down connection point at the master subsystem.

The capabilities of the present invention can be implemented in software, firmware, hardware or some combination thereof.

As described above, embodiments can be embodied in the form of computer-implemented processes and apparatuses for practicing those processes. In exemplary embodiments, the invention is embodied in computer program code executed by one or more processing circuits. Embodiments include computer program code containing instructions embodied in tangible media, such as floppy diskettes, CD-ROMs, hard drives, universal serial bus (USB) flash drives, nonvolatile memory, or any other computer-readable storage medium, wherein, when the computer program code is loaded into and executed by a processing system including a processing circuit, the processing system becomes an apparatus for practicing the invention. Embodiments include computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a processing system, the processing system becomes an apparatus for practicing the invention. When implemented on a microprocessor, the computer program code segments configure the microprocessor to create specific logic circuits.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method for providing remote access to multiple subsystems (102) of an elevator control system (104) comprising:

receiving a request to establish a remote connection at an elevator control subsystem (112) from a remote user system (110) via a communication unit (106) connected to the elevator control subsystem (112) of the multiple subsystems (102);

determining whether a local connection is established between the elevator control subsystem (112) and service equipment (120);

establishing the remote connection in response to determining that the local connection is not established between the elevator control subsystem (112) and the service equipment (120); and sending a time since the service equipment (120) was last active on the local connection and providing an option to complete the remote connection in response to determining that the local connection is established between the elevator control subsystem (112) and the service equipment (120), the elevator control subsystem (112) is operating in a first mode of operation, and a configurable local activity timeout period for communication between the elevator control subsystem (112) and the service equipment (120) has not expired.

2. The method of claim 1 further comprising:

rejecting the remote connection in response to determining that the local connection is established between the elevator control subsystem (112) and the service equipment (120), and the elevator control subsystem (112) is operating in a second mode of operation.

3. The method of claim 1 further comprising:

providing the remote user system (110) with remote access functions via the remote connection to monitor activity of the elevator control subsystem (112), interrogate the elevator control subsystem (112) for specific data, customize elevator operation, and download data for analysis in response to establishing the remote connection.

4. The method of claim 1 further comprising:

receiving a request at the elevator control subsystem (112) to remotely access a secondary elevator control subsystem (114, 116, 118) of the multiple subsystems (102);

determining whether a secondary local connection is established between the secondary elevator control subsystem (114, 116, 118) and the service equipment (120);

configuring the elevator control subsystem (112) to act as a communication pass-thru device between the remote user system (110) and the secondary elevator control subsystem (114, 116, 118) in response to determining that the secondary local connection is not established; and sending a time since the service equipment (120) was last active on the secondary local connection and providing an option to complete a pass-thru remote connection in response to determining that the secondary local connection is established, the elevator control subsystem (112) is operating in the first mode of operation, and a configurable secondary local activity timeout period for communication between the secondary elevator control subsystem (114, 116, 118) and the service equipment (120) has not expired.

5. The method of claim 4 further comprising:

rejecting the request in response to determining that the secondary local connection is established, and the elevator control subsystem (112) is operating in a second mode of operation.

6. The method of claim 4 wherein the secondary elevator control subsystem (114, 116, 118) is a parent subsystem and the elevator control subsystem (112) is a child subsystem in a control hierarchy of the elevator control system (104).

7. The method of claim 4 further comprising:

providing the remote user system (110) with remote access functions via the remote connection and the elevator control subsystem (112) to monitor activity of the secondary elevator control subsystem (114, 116, 118), interrogate the secondary elevator control subsystem (114, 116, 118) for specific data, customize elevator operation, and download data for analysis.

8. The method of claim 1 further comprising:

monitoring activity on the remote connection in response to establishing the remote connection; and closing the remote connection in response to inactivity on the remote connection for a configurable remote activity timeout period.

9. The method of claim 1 further comprising:

monitoring for a local connection attempt in response to establishing the remote connection;

preventing the local connection attempt from establishing the local connection in response to determining that the remote connection is established, and a configurable remote activity timeout period has not expired; and sending a local connection attempt warning message to the remote user system (110) in response to detecting the local connection attempt.

10. A system for providing remote access to multiple subsystems (102) of an elevator control system (104), comprising:

an elevator control subsystem (112) of the multiple subsystems (102) configurable to communicate with a remote user system (110) via a communication unit (106), the elevator control subsystem (112) comprising:

a service interface (312) configurable to communicate with service equipment (120);

an external communication interface (316) configurable to communicate with the communication unit (106);

a communication timer (318); and a processing circuit (302) to execute remote access logic (320), the remote access logic (320) comprising a method of:

receiving a request to establish a remote connection at the elevator control subsystem (112) from the remote user system (110) via the external communication interface (316);

determining whether a local connection is established between the elevator control subsystem (112) and service equipment (120) via the service interface (312);

establishing the remote connection in response to determining that the local connection is not established between the elevator control subsystem (112) and the service equipment (120); and sending a time since the service equipment (120) was last active on the local connection and providing an option to complete the remote connection in response to determining that the local connection is established between the elevator control subsystem (112) and the service equipment (120), the elevator control subsystem (112) is operating in a first mode of operation, and a configurable local activity timeout period for communication between the elevator control subsystem (112) and the service equipment (120) has not expired as monitored using the communication timer (318).

11. The system of claim 10 wherein the remote access logic (320) further comprises a method of:

rejecting the remote connection in response to determining that the local connection is established between the elevator control subsystem (112) and the service equipment (120), and the elevator control subsystem (112) is operating in a second mode of operation.

12. The system of claim 10 wherein the remote access logic (320) further comprises a method of:

providing the remote user system (110) with remote access functions via the remote connection to monitor activity of the elevator control subsystem (112), interrogate the elevator control subsystem (112) for specific data, customize elevator operation, and download data for analysis in response to establishing the remote connection.

13. The system of claim 10 wherein the multiple subsystems (102) further comprise a secondary elevator control subsystem (114, 116, 118), the elevator control subsystem (112) further comprises subsystem communication interfaces (314) to communicate with the secondary elevator control subsystem (114, 116, 118), and the remote access logic (320) further comprises a method of:

receiving a request at the elevator control subsystem (112) to remotely access the secondary elevator control subsystem (114, 116, 118);

determining whether a secondary local connection is established between the secondary elevator control subsystem (114, 116, 118) and the service equipment (120);

configuring the elevator control subsystem (112) to act as a communication pass-thru device between the remote user system (110) and the secondary elevator control subsystem (114, 116, 118) in response to determining that the secondary local connection is not established; and sending a time since the service equipment (120) was last active on the secondary local connection and providing an option to complete a pass-thru remote connection in response to determining that the secondary local connection is established, the elevator control subsystem (112) is operating in the first mode of operation, and a configurable secondary local activity timeout period for communication between the secondary elevator control subsystem (114, 116, 118) and the service equipment (120) has not expired.

14. The system of claim 13 wherein the remote access logic (320) further comprises a method of:

rejecting the request in response to determining that the secondary local connection is established, and the elevator control subsystem (112) is operating in a second mode of operation.

15. The system of claim 13 wherein the secondary elevator control subsystem (114, 116, 118) is a parent subsystem and the elevator control subsystem (112) is a child subsystem in a control hierarchy of the elevator control system (104).

16. The system of claim 10 wherein the remote access logic (320) further comprises a method of:

monitoring activity on the remote connection in response to establishing the remote connection; and closing the remote connection in response to inactivity on the remote connection for a configurable remote activity timeout period.

17. The system of claim 10 wherein the remote access logic (320) further comprises a method of:

monitoring for a local connection attempt on the service interface (312) in response to establishing the remote connection; and sending a local connection attempt warning message to the remote user system (110) in response to detecting the local connection attempt.

18. The system of claim 10 further comprising multiple elevator control systems (104), wherein the multiple elevator control systems (104) share communication with the communication unit (106).

* * * * *